US008878453B1

(12) United States Patent
Choudhury et al.

(10) Patent No.: US 8,878,453 B1
(45) Date of Patent: Nov. 4, 2014

(54) SWITCH CIRCUIT FOR A BALLAST

(71) Applicants: Ayan Choudhury, Danvers, MA (US); Arindam Chakraborty, Chicago, IL (US); Shashank Bakre, Burlington, MA (US)

(72) Inventors: Ayan Choudhury, Danvers, MA (US); Arindam Chakraborty, Chicago, IL (US); Shashank Bakre, Burlington, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 0 days.

(21) Appl. No.: 13/917,362

(22) Filed: Jun. 13, 2013

(51) Int. Cl.
*H05B 37/02* (2006.01)
*H05B 41/285* (2006.01)

(52) U.S. Cl.
CPC ..... *H05B 41/2853* (2013.01)
USPC ..... 315/291; 315/307; 315/246

(58) Field of Classification Search
CPC ..... H05B 33/0815; H05B 33/0818; H05B 41/2928
USPC ..... 315/307, 246, 291
See application file for complete search history.

(56) References Cited

U.S. PATENT DOCUMENTS

| | | | | |
|---|---|---|---|---|
| 6,177,782 | B1 * | 1/2001 | L'Hermite et al. | 323/222 |
| 2008/0180037 | A1 * | 7/2008 | Srimuang | 315/246 |
| 2008/0224636 | A1 * | 9/2008 | Melanson | 315/307 |
| 2013/0020966 | A1 * | 1/2013 | Zhang et al. | 315/307 |

* cited by examiner

*Primary Examiner* — Thuy Vinh Tran
*Assistant Examiner* — Syed M Kaiser
(74) *Attorney, Agent, or Firm* — Shaun P. Montana

(57) ABSTRACT

A ballast comprises an inverter circuit for connecting to a lamp and providing power thereto. The ballast includes a current feedback circuit connected to the inverter circuit and the lamp for controlling the frequency of the inverter circuit based on current feedback from the lamp. The ballast includes a switch circuit connected to the current feedback circuit and the lamp for enabling the current feedback circuit when the lamp is in a normal operating state and disabling the current feedback circuit when the lamp is in a low current operating state.

13 Claims, 3 Drawing Sheets

SWITCH CIRCUIT FOR A BALLAST

TECHNICAL FIELD

The present invention relates to lighting, and more specifically, to electronic ballasts for lighting.

BACKGROUND

Typically, a ballast provides power to a lamp and regulates the current and/or power provided to the lamp. Lamps, such as fluorescent lamps, use a ballast to provide the proper starting voltage for the lamp and to control the operating current once the lamp is ignited. One type of fluorescent lamp that is commonly used is a T8 lamp.

Generally, a ballast is configured to provide appropriate and substantially consistent current to the lamp(s) connected thereto. Ballasts sometimes have the capability to detect current feedback from the lamp(s) and adjust the current signal going into the lamp(s) accordingly to ensure substantially consistent operation. This can be done by adjusting the frequency at which an inverter circuit in the ballast drives the lamp(s). However, in certain situations, adjusting the frequency of the inverter circuit can result in damage to the ballast. When a lamp is first connected to a ballast, most ballasts will automatically activate the inverter circuit to begin driving the lamp. There is a period of time upon connection during which the lamp has not reached a normal operating state and the lamp current will be zero or very low. During this time period, if the ballast adjusts the frequency at which the inverter circuit is driving the lamp, it can result in the inverter circuit going into hard switching mode (e.g., a stressful state in which transistors switch rapidly while exposed to full voltage and full current simultaneously), which, in turn, can damage the inverter circuit. It is desirable for the ballast to maintain a relatively constant inverter circuit frequency until the newly connected lamp reaches a normal operating state, and then to adjust the frequency of the inverter circuit to maintain substantially consistent operation of the lamp.

SUMMARY

Embodiments of the present invention provide a switch circuit for a ballast that detects whether a lamp connected to the ballast is in a low current operating state (e.g., the current through the lamp is substantially zero), and if the lamp is in a low current operating state, the switch circuit prevents the frequency of the inverter circuit from being adjusted. In one embodiment, a ballast for energizing one or more lamps connected thereto comprises an inverter circuit receiving a voltage signal and providing a lamp voltage to the one or more lamps for energizing the one or more lamps.

A current feedback circuit is connected to the inverter circuit and receives current feedback from the one or more lamps. The current feedback circuit is configured to operate between an enabled state and a disable state. In an enabled state, the current feedback circuit controls the frequency at which the inverter circuit drives the one or more lamps in response to the current feedback in order to maintain substantially consistent operation of the one or more lamps. In a disabled state, the current feedback circuit is disabled from controlling the frequency of the inverter circuit. A switch circuit is connected to the current feedback circuit and receives current feedback from the one or more lamps. If the switch circuit detects substantially zero current through the one or more lamps, the switch circuit disables the current feedback circuit such that the frequency of the inverter circuit is not being controlled in response to the current feedback from the one or more lamps. If the switch circuit detects current through the one or more lamps, the switch circuit enables the current feedback circuit such that the frequency of the inverter circuit is being controlled in response to the current feedback from the one or more lamps.

In an embodiment, there is provided a ballast. The ballast includes; an inverter circuit that operates at a frequency to generate a current signal to energize one or more lamps; a current feedback circuit connected to the inverter circuit and adapted to connect to the one or more lamps and to receive current feedback from the one or more lamps, wherein the current feedback circuit is configured to operate between an enabled state and a disabled state, wherein the current feedback circuit is configured to control the frequency of the inverter circuit based on the current feedback when the current feedback circuit operates in the enabled state, and the current feedback circuit is disabled from controlling the frequency of the inverter circuit when the current feedback circuit operates in the disabled state; and a switch circuit connected to the current feedback circuit and adapted to connect to the one or more lamps to detect a current signal through the one or more lamps, wherein the switch circuit is configured to selectively enable and disable the current feedback circuit based on the detected current signal, wherein the switch circuit is configured to disable the current feedback circuit when the current signal through the one or more lamps is less than or equal to a minimum threshold and to enable the current feedback circuit when the current signal through the one or more lamps is greater than the minimum threshold.

In a related embodiment, the current feedback circuit may include an operational amplifier that may compare the current feedback input from the one or more lamps to a reference input, the difference between the current feedback input and the reference input determining the degree to which the frequency of the inverter circuit may be altered by the current feedback circuit. In a further related embodiment, the switch circuit may include a switch component connected to a power source of the operational amplifier in the current feedback circuit, the switch component may be configured to selectively operate between an open state and a closed state, wherein when the switch component operates in the open state the switch component enables the power source to power the operational amplifier, and when the switch component operates in the closed state the switch component grounds the power source such that it disables the operational amplifier.

In another related embodiment, the current feedback circuit may include a microcontroller that performs a comparison of the current feedback input from the one or more lamps to a reference input, wherein the frequency of the inverter circuit may be altered by an amount that corresponds to the comparison. In a further related embodiment, the switch circuit may include a switch component connected to a power source of the microcontroller in the current feedback circuit, the switch component may be configured to selectively operate between an open state and a closed state, wherein when the switch component operates in the open state the switch component enables the power source to power the microcontroller, and when the switch component operates in the closed state the switch component grounds the power source and thereby disables the microcontroller.

In yet another related embodiment, the minimum threshold may be substantially zero current.

In another embodiment, there is provided a ballast. The ballast includes: a high voltage input terminal configured to be connected to an alternating current power supply; a neutral input terminal; a ground terminal configured to be connected to a ground potential; an electromagnetic interference (EMI) filter circuit; a rectifier circuit; a power factor correction circuit; an inverter circuit that operates at a frequency to generate a current signal to energize one or more lamps; a current feedback circuit connected to the inverter circuit and adapted to connect to the one or more lamps and to receive current feedback from the one or more lamps, wherein the current feedback circuit is configured to operate between an enabled state and a disabled state, wherein the current feedback circuit is configured to control the frequency of the inverter circuit based on the current feedback when the current feedback circuit operates in the enabled state, and the current feedback circuit is disabled from controlling the frequency of the inverter circuit when the current feedback circuit operates in the disabled state; and a switch circuit connected to the current feedback circuit and adapted to connect to the one or more lamps to detect a current signal through the one or more lamps, wherein the switch circuit is configured to selectively enable and disable the current feedback circuit based on the detected current signal, wherein the switch circuit is configured to disable the current feedback circuit when the current signal through the one or more lamps is less than or equal to a minimum threshold and to enable the current feedback circuit when the current signal through the one or more lamps is greater than the minimum threshold.

In a related embodiment, the current feedback circuit may include an operational amplifier that may perform a comparison of the current feedback input from the one or more lamps to a reference input, wherein the frequency of the inverter circuit may be altered by an amount that corresponds to the comparison. In a further related embodiment, the switch circuit may include a switch component connected to a power source of the operational amplifier in the current feedback circuit, wherein the switch component may be configured to selectively operate between an open state and a closed state, wherein when the switch component operates in the open state the switch component enables the power source to power the operational amplifier, and when the switch component operates in the closed state the switch component grounds the power source such that it disables the operational amplifier.

In another related embodiment, the current feedback circuit may include a microcontroller that performs a comparison of the current feedback input from the one or more lamps to a reference input, wherein the frequency of the inverter circuit may be altered by an amount that corresponds to the comparison. In a further related embodiment, the switch circuit may include a switch component connected to a power source of the microcontroller in the current feedback circuit, the switch component may be configured to selectively operate between an open state and a closed state, wherein when the switch component operates in the open state the switch component enables the power source to power the microcontroller, and when the switch component operates in the closed state the switch component grounds the power source such that it disables the microcontroller.

In still another related embodiment, the minimum threshold may be substantially zero current.

In another embodiment, there is provided a frequency control circuit adapted to connect to an inverter circuit that operates at a frequency and is adapted to connect to one or more lamps. The frequency control circuit includes: a ground potential terminal; a current feedback circuit configured to receive current feedback from the one or more lamps, wherein the current feedback circuit is configured to operate between an enabled state and a disabled state, wherein the current feedback circuit is configured to control the frequency of the inverter circuit based on the current feedback when the current feedback circuit operates in the enabled state, and the current feedback circuit is disabled from controlling the frequency of the inverter circuit when the current feedback circuit operates in the disabled state, the current feedback circuit having a first input connectable to the ground potential terminal, wherein when first input is connected to the ground potential terminal the current feedback circuit operates in the disabled state and when the first input is unconnected to the ground potential terminal the current feedback circuit operates in the enabled state; and a switch circuit including: a second input configured to be connected to one or more lamps and to receive current feedback from the one or more lamps; an output connected to the first input of the current feedback circuit; a first node; a first switch component connected to the second input of the switch circuit, the first node, and a ground potential terminal, the first switch component configured to selectively operate between a closed state and an open state, wherein when the first switch component operates in the closed state the first switch component connects the first node to the ground potential terminal and when the first switch component operates in the open state the first switch component disconnects the first node from the ground potential terminal, wherein the state of the first switch component is determined by the current feedback from the one or more lamps received by the second input; and a second switch component connected to the first node, the ground potential terminal, and the output, the second switch component configured to selectively operate between a closed state and an open state, wherein when the second switch component operates in the closed state the second switch component connects the output to the ground potential terminal and when the second switch component operates in the open state the second switch component disconnects the output from the ground potential terminal, wherein the second switch component operates in the closed state when the first node is disconnected from the ground potential terminal and the second switch component operates in the open state when the first node is connected to the ground potential terminal; wherein the output of the switch circuit is connected to the first input of the current feedback circuit such that when the output of the switch circuit is connected to the ground potential terminal the current feedback circuit operates in the disabled state and when the output of the switch circuit is disconnected from the ground potential terminal the current feedback circuit operates in the enabled state.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
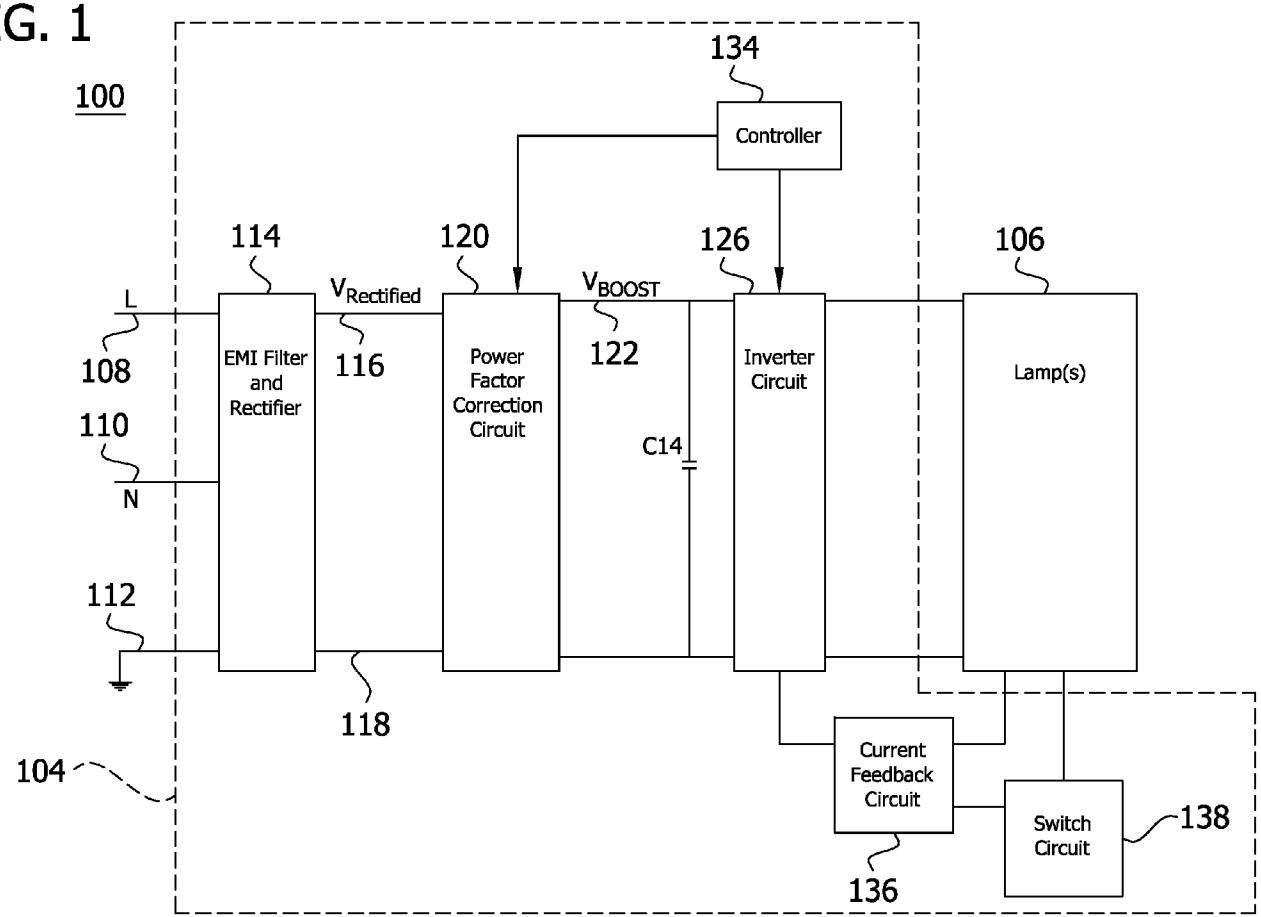
FIG. 1 is a partial schematic, partial block diagram of a lamp system having a ballast for use with an input power source to energize a lamp according to embodiments disclosed herein.

FIG. 1 illustrates a lamp system 100 according to an embodiment of the invention. The lamp system 100 includes an input power source (not shown), such as but not limited to an alternating current (AC) power source, an electronic ballast 104 (also referred to throughout as a ballast 104), and a lamp 106. In some embodiments, the lamp 106 is a low pressure discharge lamp, such as but not limited to a T8 fluorescent lamp. For example, the lamp 106 may be model number FT40DL available from OSRAM SYLVANIA. However, it should be noted that the lamp system 100 may be, and in some embodiments is, used for energizing other types of lamps without departing from the scope of the invention. Further, in some embodiments, the lamp system 100 is used for energizing more than one lamp 106.

The ballast 104 includes at least one high voltage input terminal (i.e., line voltage input terminal) 108 adapted for connecting to the alternating current (AC) power supply (e.g., standard 120V AC household power), a neutral input terminal 110, and a ground terminal 112 connectable to ground potential. An input AC power signal is received by the ballast 104 from the AC power supply (not shown) via the high voltage input terminal 108. The ballast 104 includes an electromagnetic interference (EMI) filter and a rectifier (e.g., full-wave rectifier) 114, which are illustrated together in FIG. 1. The EMI filter portion of the EMI filter and rectifier 114 prevents noise that may be generated by the ballast 104 from being transmitted back to the AC power supply. The rectifier portion of the EMI filter and rectifier 114 converts AC voltage received from the AC power supply to a rectified voltage and includes a first output terminal connected to a DC bus 116 and a second output terminal connected to a ground potential at ground connection point 118. Thus, the EMI filter and rectifier 114 outputs a rectified voltage ($V_{Rectified}$) on the DC bus 116.

Figure 2:
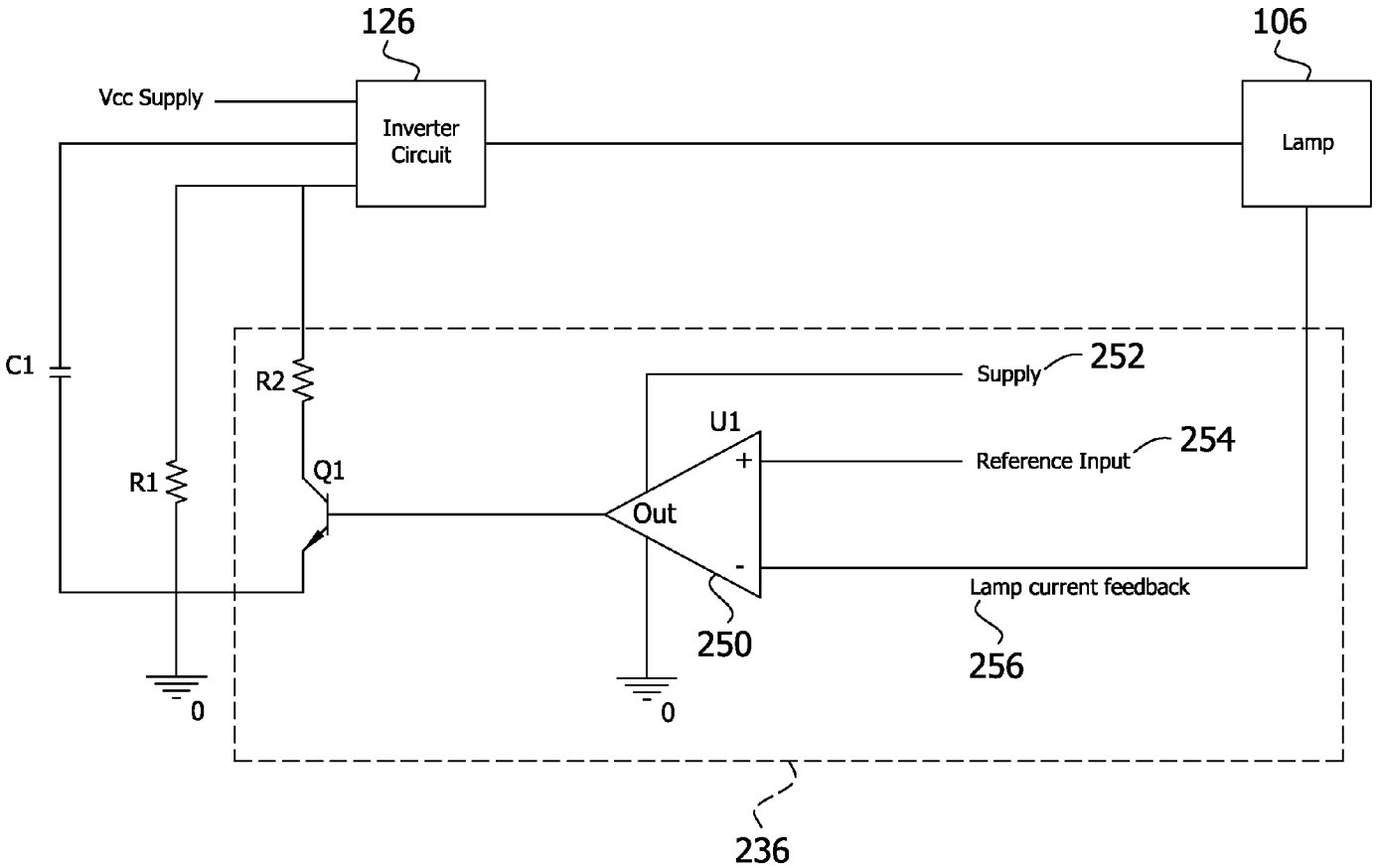
FIG. 2 is a partial schematic, partial block diagram of a current feedback circuit of a ballast according to embodiments disclosed herein.

A power factor correction circuit 120, which may be, and in some embodiments is, a boost converter, is connected to the first and second output terminals of the EMI filter and rectifier 114. The power factor correction circuit 120 receives the rectified voltage ($V_{Rectified}$) and produces a high voltage ($V_{Boost}$) on a high DC voltage bus ("high DC bus") 122. A shunt capacitor C14 is connected across the output of the power factor correction circuit 120. An inverter circuit 126 has an input connected to the power factor correction circuit 120 for receiving the high voltage ($V_{Boost}$) from the power factor correction circuit 120. The inverter circuit 126 is configured to convert the high voltage ($V_{Boost}$) from the power factor correction circuit 120 to an oscillating power signal for supplying to the lamp 106. In some embodiments, the inverter circuit 126 includes a first switching component and a second switching component. The switching components complementarily operate between a non-conductive state and a conductive state in order to produce the oscillating power signal. The frequency of the oscillating power signal is determined by the values of a resistor R1 and a capacitor C1 that are part of the inverter circuit 126. The resistor R1 and capacitor C1 are shown in FIG. 2 and described below. In some embodiments, a controller 134 enables control over the power factor correction circuit 120, the inverter circuit 126, and/or both.

A current feedback circuit 136 is connected to the inverter circuit 126, the lamp 106, and a switch circuit 138. An exemplary current feedback circuit 136 is shown in FIG. 2. The current feedback circuit controls the frequency of the inverter circuit 126 in response to the current feedback from the lamp 106 in order to maintain substantially consistent operation of the lamp 106. The current feedback circuit 136 is configured to operate between an enabled state and a disabled state. In an enabled state, the current feedback circuit 136 controls the frequency at which the inverter circuit 126 drives the one or more lamps 106 in response to the current feedback in order to maintain substantially consistent operation of the one or more lamps 106. In a disabled state, the current feedback circuit 136 is disabled from controlling the frequency of the inverter circuit 126.

Figure 3:
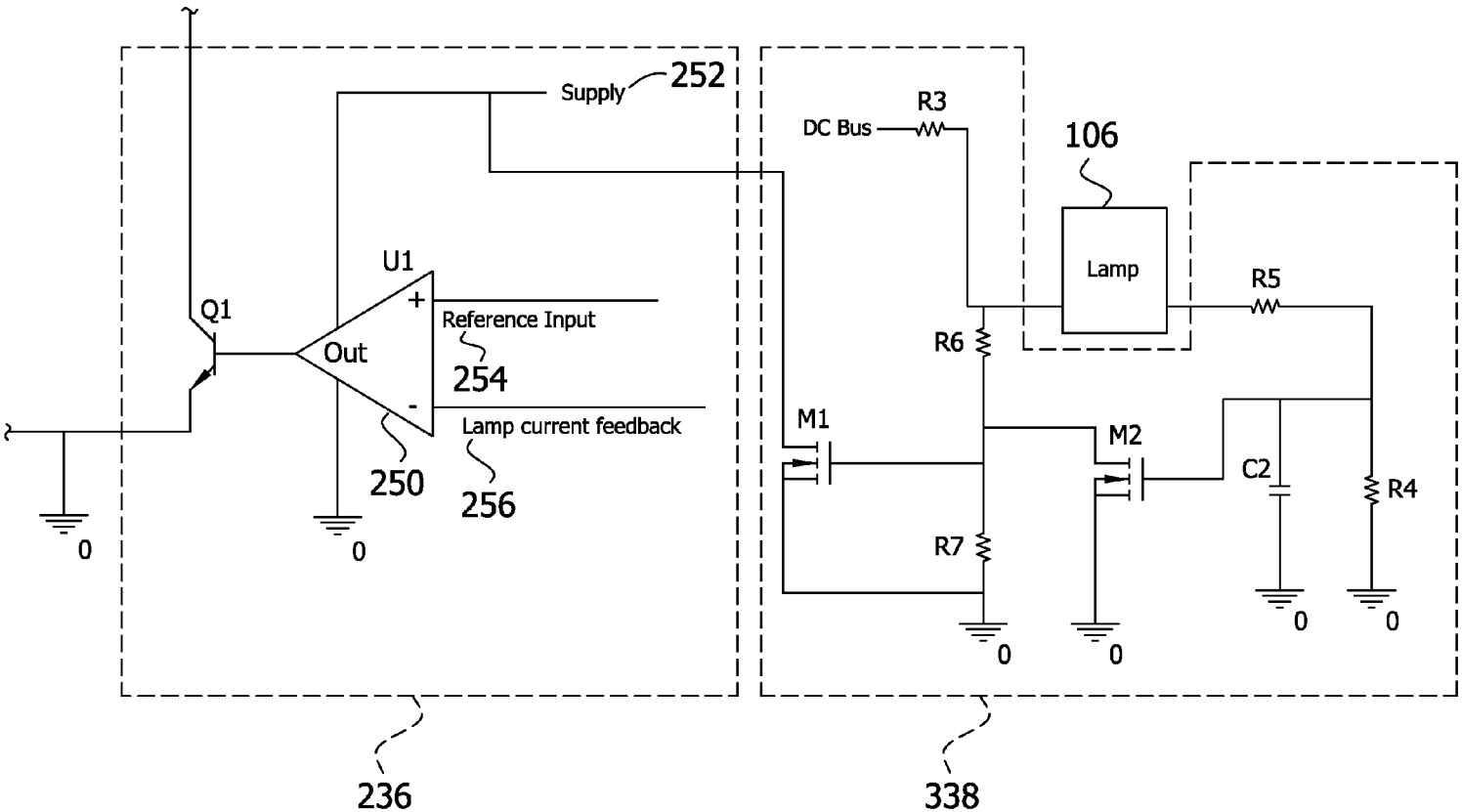
FIG. 3 is a partial schematic, partial block diagram of a switch circuit of a ballast according to embodiments disclosed herein.

A switch circuit 138 is connected to the current feedback circuit 136 and the lamp 106. An exemplary switch circuit 138 is shown in FIG. 3 and described below. The switch circuit 138 is connected to the current feedback circuit 136 such that it is capable of enabling or disabling the current feedback circuit 136 depending on the level of current the switch circuit 138 detects in the lamp 106. In a case where the lamp 106 is operating within a normal current range (e.g., the current through the lamp 106 is greater than substantially zero), the switch circuit 138 will enable the current feedback circuit 136 such that it can control the frequency of the inverter circuit 126. In a case where the lamp 106 has substantially zero current, the switch circuit 138 will disable the current feedback circuit 136 such that the current feedback circuit 136 exerts no control over the frequency of the inverter circuit 126 and the inverter circuit 126 runs at a predefined frequency.

FIG. 2 illustrates a current feedback circuit 236. The current feedback circuit 236 includes a comparing component 250, such as but not limited to an operational amplifier (op-amp) U1, a transistor Q1, and a resistor R2. In some embodiments, the comparing component 250 includes a microcontroller in place of the op-amp U1 (not shown, but may be, and in some embodiments is, the controller 134 shown in FIG. 1). The frequency of the inverter circuit 126 for energizing the lamp 106 is determined based on the values of a capacitor C1 and a resistor R1. The op-amp U1 has a non-inverting input terminal, an inverting input terminal, an output terminal, a positive power supply terminal, and a negative power supply terminal, which are connected as follows. The inverting input terminal is adapted for connecting to the lamp 106 for receiving a current feedback signal 256 therefrom. A reference input 254 is connected to the non-inverting input terminal, a supply voltage 252 is connected to the positive power supply terminal, and the negative power supply terminal is connected to a ground potential 0. The transistor Q1 has a base terminal, a collector terminal, and an emitter terminal. The base terminal is connected to the output terminal of the op-amp U1, the emitter terminal is connected to the ground potential 0, and the collector terminal is connected in series to a resistor R2. The series connected transistor Q1 and the resistor R2 are connected in parallel with the resistor R1. Thus, the op-amp U1 is able to drive the base terminal of the transistor Q1 to a threshold voltage, allowing current to flow from the collector terminal to the emitter terminal. As such, the impedance of the transistor Q1 and the resistor R2 open in parallel with the resistor R1, thereby changing the effective resistance across the resistor R1 and the frequency of the inverter circuit 126. The difference between the reference input 254 and the current feedback 256 received from the lamp determines whether the op-amp U1 will drive the base terminal of the transistor Q1 to the threshold voltage and to what degree the current feedback circuit 236 alters the frequency of inverter circuit 126. If the lamp current feedback 256 falls sufficiently in comparison to the reference input 254, the op-amp U1 will drive the transistor Q1 such that the frequency of the inverter circuit 126 decreases. As the current through the lamp 106 changes during operation, the lamp current feedback 256 changes with respect to the reference input 254, thereby altering the frequency of the inverter circuit 126 in response to changes in current through the lamp 106.

FIG. 3 illustrates a switch circuit 338. The switch circuit 338 includes resistors R3, R4, R5, R6, and R7, switch components such as metal-oxide-semiconductor field-effect transistors (MOSFETs) M1 and M2, and a capacitor C2. The resistor R3 is connected to a Direct Current (DC) Bus and a first node. The lamp 106 is connected to the first node and a second node. The resistor R5 is connected to the second node and a third node. The resistor R4 is connected to the third node and the ground potential 0. The capacitor C2 is connected to the third node and the ground potential 0 in parallel with the resistor R4. The MOSFET M2 has a gate terminal, a source terminal, and a drain terminal, connected as follows: the gate terminal is connected to the third node, the source terminal is connected to ground potential, and the drain terminal is connected to a fourth node. The resistor R6 is connected between the first node and the fourth node. The resistor R7 is connected between the fourth node and the ground potential 0. The MOSFET M1 has a gate terminal, a source terminal, and a drain terminal, connected as follows: the gate terminal is connected to the fourth node, the source terminal is connected to the ground potential 0, and the drain terminal is connected to a positive power supply terminal of an op-amp U1 in a current feedback circuit 236, which may be, and in some embodiments is, the current feedback circuit 236 of FIG. 2.

In operation, when current below a minimum threshold (i.e., substantially zero) is flowing through the lamp 106, current flows through the resistors R5 and R4, the capacitor C2, and into the gate terminal of the MOSFET M2. The gate voltage of the MOSFET M2 is driven sufficiently high to allow current to freely flow between the ground potential 0 and the fourth node (i.e., the MOSFET M2 operates in a closed state), driving the gate voltage of the MOSFET M1 to the ground potential 0. This causes the MOSFET M1 to operate in an open state such that current cannot flow between the source and drain terminals thereof. When the MOSFET M1 is operating in an open state, a supply 252 of the op-amp U1 in the current feedback circuit 236 powers the op-amp U1 and allows the current feedback circuit 236 to control the frequency of the inverter circuit 126 as previously described.

During low current operation, when current flow through the lamp 106 is substantially zero, the gate voltage of the MOSFET M2 is driven low. This causes the MOSFET M2 to be open, such that current cannot freely flow between the ground potential 0 and the fourth node. The gate voltage of the MOSFET M1 is driven high due to the voltage across the resistor R7 as the current flows from the DC Bus across the resistors R3, R6 and R7. The MOSFET M1 is closed and grounds the power supply of the op-amp U1, disabling the current feedback circuit 236. Because the op-amp U1 becomes unpowered, it cannot drive the transistor Q1 to control the frequency of the inverter circuit 126.

The switch circuit 338 prevents the current feedback circuit 236 from controlling the frequency of the inverter circuit 126 before there is current flowing through lamp 106. When there is substantially zero current flowing through the lamp 106, the current feedback circuit 236 is receiving a substantially zero current feedback signal 256. This causes the current feedback circuit 236 to drive the frequency of the inverter circuit 126 very low. Driving the frequency of the inverter circuit 126 very low while the lamp 106 has substantially zero current may cause the inverter circuit 126 to enter hard switching mode, which may be harmful to components in the inverter circuit 126. The inclusion of the switch circuit 338 prevents the inverter circuit 126 from entering hard switching mode by disabling the current feedback circuit 236, such that the inverter circuit 126 will run at a predefined frequency until current is detected through the lamp 106. Once the lamp 106 current is detected, it is safe for the current feedback circuit 236 to control the frequency of the inverter circuit 126 and the switch circuit 338 enables the current feedback circuit 236.

References to "a microprocessor"/"a processor"/"a microcontroller"/"a controller", or the "microprocessor"/"the processor"/"the microcontroller"/"the controller" may be understood to include one or more microprocessors that may communicate in a stand-alone and/or a distributed environment(s), and may thus be configured to communicate via wired or wireless communications with other processors, where such one or more processor may be configured to operate on one or more processor-controlled devices that may be similar or different devices. Use of such terminology may thus also be understood to include a central processing unit, an arithmetic logic unit, an application-specific integrated circuit (IC), and/or a task engine, with such examples provided for illustration and not limitation, and in some embodiments including memory.

Furthermore, references to memory, unless otherwise specified, may include one or more processor-readable and accessible memory elements and/or components that may be internal to the processor-controlled device, external to the processor-controlled device, and/or may be accessed via a wired or wireless network using a variety of communications protocols, and unless otherwise specified, may be arranged to include a combination of external and internal memory devices, where such memory may be contiguous and/or partitioned based on the application. Accordingly, references to a database may be understood to include one or more memory associations, where such references may include commercially available database products (e.g., SQL, Informix, Oracle) and also proprietary databases, and may also include other structures for associating memory such as links, queues, graphs, trees, with such structures provided for illustration and not limitation.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or an and/or the to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A ballast, comprising:

an inverter circuit that operates at a frequency to generate a current signal to energize one or more lamps;

a current feedback circuit connected to the inverter circuit and adapted to connect to the one or more lamps and to receive current feedback from the one or more lamps, wherein the current feedback circuit is configured to operate between an enabled state and a disabled state, wherein the current feedback circuit is configured to control the frequency of the inverter circuit based on the current feedback when the current feedback circuit operates in the enabled state, and the current feedback circuit is disabled from controlling the frequency of the inverter circuit when the current feedback circuit operates in the disabled state, the current feedback circuit having a first input connectable to a ground potential terminal, wherein when first input is connected to the ground potential terminal the current feedback circuit operates in the disabled state and when the first input is unconnected to the ground potential terminal the current feedback circuit operates in the enabled state; and a switch circuit comprising:

a second input configured to be connected to one or more lamps and to receive current feedback from the one or more lamps;

an output connected to the first input of the current feedback circuit;

a first node;

a first switch component connected to the second input of the switch circuit, the first node, and the ground potential terminal, the first switch component configured to selectively operate between a closed state and an open state, wherein when the first switch component operates in the closed state the first switch component connects the first node to the ground potential terminal and when the first switch component operates in the open state the first switch component disconnects the first node from the ground potential terminal, wherein the state of the first switch component is determined by the current feedback from the one or more lamps received by the second input; and a second switch component connected to the first node, the ground potential terminal, and the output, the second switch component configured to selectively operate between a closed state and an open state, wherein when the second switch component operates in the closed state the second switch component connects the output to the ground potential terminal and when the second switch component operates in the open state the second switch component disconnects the output from the ground potential terminal, wherein the second switch component operates in the closed state when the first node is disconnected from the ground potential terminal and the second switch component operates in the open state when the first node is connected to the ground potential terminal;

wherein the output of the switch circuit is connected to the first input of the current feedback circuit such that when the output of the switch circuit is connected to the ground potential terminal the current feedback circuit operates in the disabled state and when the output of the switch circuit is disconnected from the ground potential terminal the current feedback circuit operates in the enabled state.

2. The ballast of claim 1, wherein the current feedback circuit comprises an operational amplifier that compares the current feedback input from the one or more lamps to a reference input, the difference between the current feedback input and the reference input determining the degree to which the frequency of the inverter circuit is altered by the current feedback circuit.

3. The ballast of claim 2, wherein the first switch component is connected to a power source of the operational amplifier in the current feedback circuit, wherein when the first switch component operates in the open state the first switch component enables the power source to power the operational amplifier, and when the first switch component operates in the closed state the first switch component grounds the power source such that it disables the operational amplifier.

4. The ballast of claim 1, wherein the current feedback circuit comprises a microcontroller that performs a comparison of the current feedback input from the one or more lamps to a reference input, wherein the frequency of the inverter circuit is altered by an amount that corresponds to the comparison.

5. The ballast of claim 4, wherein the first switch component is connected to a power source of the microcontroller in the current feedback circuit, wherein when the first switch component operates in the open state the first switch component enables the power source to power the microcontroller, and when the first switch component operates in the closed state the first switch component grounds the power source and thereby disables the microcontroller.

6. The ballast of claim 1, wherein the minimum threshold is substantially zero current.

7. A ballast, comprising:

a high voltage input terminal configured to be connected to an alternating current power supply;

a neutral input terminal;

a ground terminal configured to be connected to a ground potential;

an electromagnetic interference (EMI) filter circuit;

a rectifier circuit;

a power factor correction circuit;

an inverter circuit that operates at a frequency to generate a current signal to energize one or more lamps;

a current feedback circuit connected to the inverter circuit and adapted to connect to the one or more lamps and to receive current feedback from the one or more lamps, wherein the current feedback circuit is configured to operate between an enabled state and a disabled state, wherein the current feedback circuit is configured to control the frequency of the inverter circuit based on the current feedback when the current feedback circuit operates in the enabled state, and the current feedback circuit is disabled from controlling the frequency of the inverter circuit when the current feedback circuit operates in the disabled state, the current feedback circuit having a first input connectable to the ground terminal, wherein when first input is connected to the ground terminal the current feedback circuit operates in the disabled state and when the first input is unconnected to the ground terminal the current feedback circuit operates in the enabled state; and a switch circuit comprising:

a second input configured to be connected to one or more lamps and to receive current feedback from the one or more lamps;

an output connected to the first input of the current feedback circuit;

a first node;

a first switch component connected to the second input of the switch circuit, the first node, and the ground terminal, the first switch component is configured to selectively operate between a closed state and an open state, wherein when the first switch component operates in the closed state the first switch component connects the first node to the ground terminal and when the first switch component operates in the open state the first switch component disconnects the first node from the ground terminal, wherein the state of the first switch component is determined by the current feedback from the one or more lamps received by the second input; and a second switch component connected to the first node, the ground terminal, and the output, the second switch component configured to selectively operate between a closed state and an open state, wherein when the second switch component operates in the closed state the second switch component connects the output to the ground terminal and when the second switch component operates in the open state the second switch component disconnects the output from the ground terminal, wherein the second switch component operates in the closed state when the first node is disconnected from the ground terminal and the second switch component operates in the open state when the first node is connected to the ground terminal;

wherein the output of the switch circuit is connected to the first input of the current feedback circuit such that when the output of the switch circuit is connected to the ground terminal the current feedback circuit operates in the disabled state and when the output of the switch circuit is disconnected from the ground terminal the current feedback circuit operates in the enabled state.

8. The ballast of claim 7, wherein the current feedback circuit comprises an operational amplifier that performs a comparison of the current feedback input from the one or more lamps to a reference input, wherein the frequency of the inverter circuit is altered by an amount that corresponds to the comparison.

9. The ballast of claim 8, wherein the first switch component is connected to a power source of the operational amplifier in the current feedback circuit, wherein when the first switch component operates in the open state the first switch component enables the power source to power the operational amplifier, and when the first switch component operates in the closed state the first switch component grounds the power source such that it disables the operational amplifier.

10. The ballast of claim 7, wherein the current feedback circuit comprises a microcontroller that performs a comparison of the current feedback input from the one or more lamps to a reference input, wherein the frequency of the inverter circuit is altered by an amount that corresponds to the comparison.

11. The ballast of claim 10, wherein the first switch component is connected to a power source of the microcontroller in the current feedback circuit, wherein when the first switch component operates in the open state the first switch component enables the power source to power the microcontroller, and when the first switch component operates in the closed state the first switch component grounds the power source and thereby disables the microcontroller.

12. The ballast of claim 7, wherein the minimum threshold is substantially zero current.

13. A frequency control circuit adapted to connect to an inverter circuit that operates at a frequency and is adapted to connect to one or more lamps, the frequency control circuit comprising:

a ground potential terminal;

a current feedback circuit configured to receive current feedback from the one or more lamps, wherein the current feedback circuit is configured to operate between an enabled state and a disabled state, wherein the current feedback circuit is configured to control the frequency of the inverter circuit based on the current feedback when the current feedback circuit operates in the enabled state, and the current feedback circuit is disabled from controlling the frequency of the inverter circuit when the current feedback circuit operates in the disabled state, the current feedback circuit having a first input connectable to the ground potential terminal, wherein when first input is connected to the ground potential terminal the current feedback circuit operates in the disabled state and when the first input is unconnected to the ground potential terminal the current feedback circuit operates in the enabled state; and a switch circuit comprising:

a second input configured to be connected to one or more lamps and to receive current feedback from the one or more lamps;

an output connected to the first input of the current feedback circuit;

a first node;

a first switch component connected to the second input of the switch circuit, the first node, and a ground potential terminal, the first switch component configured to selectively operate between a closed state and an open state, wherein when the first switch component operates in the closed state the first switch component connects the first node to the ground potential terminal and when the first switch component operates in the open state the first switch component disconnects the first node from the ground potential terminal, wherein the state of the first switch component is determined by the current feedback from the one or more lamps received by the second input; and a second switch component connected to the first node, the ground potential terminal, and the output, the second switch component configured to selectively operate between a closed state and an open state, wherein when the second switch component operates in the closed state the second switch component connects the output to the ground potential terminal and when the second switch component operates in the open state the second switch component disconnects the output from the ground potential terminal, wherein the second switch component operates in the closed state when the first node is disconnected from the ground potential terminal and the second switch component operates in the open state when the first node is connected to the ground potential terminal;

wherein the output of the switch circuit is connected to the first input of the current feedback circuit such that when the output of the switch circuit is connected to the ground potential terminal the current feedback circuit operates in the disabled state and when the output of the switch circuit is disconnected from the ground potential terminal the current feedback circuit operates in the enabled state.

* * * * *